US006866535B2

(12) United States Patent
Uchida

(10) Patent No.: US 6,866,535 B2
(45) Date of Patent: Mar. 15, 2005

(54) PLUG AND RECEPTACLE

(75) Inventor: Shinji Uchida, Kanagawa (JP)

(73) Assignee: J.S.T. Mgf. Co., Ltd., Osaka (JP)

( * ) Notice: Subject to any disclaimer, the term of this patent is extended or adjusted under 35 U.S.C. 154(b) by 0 days.

(21) Appl. No.: 10/784,237

(22) Filed: Feb. 24, 2004

(65) Prior Publication Data

US 2004/0166711 A1 Aug. 26, 2004

(30) Foreign Application Priority Data

Feb. 25, 2003 (JP) ..... 2003-048125

(51) Int. Cl.[7] ..... H01R 13/627
(52) U.S. Cl. ..... 439/357
(58) Field of Search ..... 439/345, 350–358, 439/637, 386, 374, 567, 953

(56) References Cited

U.S. PATENT DOCUMENTS

| | | | | |
|---|---|---|---|---|
| 5,599,207 A | * | 2/1997 | Lai | 439/567 |
| 5,749,746 A | * | 5/1998 | Tan et al. | 439/357 |
| 6,290,530 B1 | * | 9/2001 | Chang | 439/378 |
| 6,413,112 B2 | * | 7/2002 | Semmeling et al. | 439/358 |
| 6,612,860 B2 | * | 9/2003 | Droesbeke | 439/357 |
| 6,702,603 B2 | * | 3/2004 | Wu | 439/352 |
| 6,743,053 B2 | * | 6/2004 | Wu | 439/634 |
| 6,786,755 B2 | * | 9/2004 | Dambach et al. | 439/353 |

FOREIGN PATENT DOCUMENTS

| | | |
|---|---|---|
| JP | 05-089926 A | 4/1993 |
| JP | 06-029058 A | 2/1994 |
| JP | 07-029636 A | 1/1995 |
| JP | 10-083867 A | 3/1998 |
| JP | 11-326693 A | 11/1999 |
| JP | 2001-217040 A | 8/2001 |
| JP | 2002-270287 A | 9/2002 |

* cited by examiner

*Primary Examiner*—J. F. Duverne
(74) *Attorney, Agent, or Firm*—Rader, Fishman & Grauer PLLC

(57) ABSTRACT

A plug includes: a plug frame portion having a cylindrical shape; a header portion for being housed in the plug frame portion; a pair of lock arms supported on the plug frame portion; and a plug shutter for moving back and forth in the inserting/extracting directions. Each of the paired lock arms includes: a body extending toward the receptacle; a hook portion formed on the forward end side of the body; and an action member formed closer to the rearward end side than the hook portion. The plug shutter includes: a cylindrical shutter frame portion; a pair of lever portions; and a pair of projections. When the plug shutter is moved backward of the receptacle by holding the lever portions with the fingers, the projections of the plug shutter push the action members of the lock arms inward to deform the lock arms inward thereby to move the hook portions of the lock arms inward.

9 Claims, 10 Drawing Sheets

PLUG AND RECEPTACLE

CROSS-REFERENCE TO RELATED APPLICATIONS

This application is based upon and claims the benefit of priority from the prior Japanese Patent Application No.2003-048125 filed on Feb. 25th in 2003, the entire contents of which is incorporated herein by reference.

FIELD OF THE INVENTION

The present invention relates to a plug and a receptacle to which the plug is to be connected.

BACKGROUND OF THE INVENTION

Conventionally, a connector having a plug and a receptacle to be connected to the plug has been known. In this connector, the receptacle is packaged in an electric device or an electronic device, for example.

This connector may be provided with a lock mechanism for connecting the plug and the receptacle surely. Especially, a cable connecting connector is frequently provided with the lock mechanism.

This lock mechanism is demanded not only for connecting the plug surely to the receptacle but also, as the case may be, for disconnecting the plug easily from the receptacle.

For example, the following two are known as the connector provided with the aforementioned lock mechanism.

In the first connector, a pair of lock levers are disposed on the two widthwise sides of the cover of the plug, and an engagement portion is disposed in the receptacle for connecting the plug. Thus, the plug is connected to and disconnected from the receptacle while pushing the individual lock levers by bringing the hooks of the lock levers into engagement with the engagement portion of the receptacle (as referred to JP-A-6-29058, for example).

The second one is a micro-connector capable of pulling the plug forcibly out of the receptacle, as shown in FIG. 10. This micro-connector includes a plug 300 and a receptacle 400 into and out of which the plug 300 is inserted and extracted.

The plug 300 includes: a plug housing 301 having a flat plate shape; a shutter 305 having a rectangular cylinder shape for covering the rearward end side of the plug housing 301 and moving back and forth along the inserting direction of the plug 300; and a pair of compression coil springs 306 for urging the shutter 305 backward of the receptacle 400.

The plug housing 301 has an insulating property and has contacts 302 of a leaf spring shape arrayed in plurality in a dual-in-line shape. On the both side faces of the plug housing 301, lock springs 303, 304 which extend along the surface are disposed.

Rearward end sides of the lock springs 303, 304 are fixed on the side faces of the plug housing 301, but Forward end sides of them are free. The lock springs 303, 304 have arcuate hook portions 33A, 34B at their forward ends, and the arcuate portions of the hook portions 33A, 34B bulge outside.

Here, the plug housing 301 is connected on its rearward end side to the not-shown cable shielding clamp.

On the other hand, the receptacle 400 includes: an insulating receptacle housing 401 having a rectangular cylinder shape; a metallic shell 408 for covering the outer periphery of the receptacle housing 401; and contacts 403 of a flat plate shape disposed on the confronting upper and lower faces of the inner wall face of the receptacle housing 401.

The receptacle housing 401 is opened on its one end side to form an opening 402 into which the plug housing 301 of the plug 300 is inserted. Here, the upper face of the receptacle housing 401 is omitted from FIG. 10.

On those both side faces of the inner wall face of the receptacle housing 401 which have none of the contacts 403 disposed thereon, slide plates 404, 405 individually disposed. These slide plates 404, 405 respectively includes recesses 44A, 45B, which confront each other.

In the receptacle housing 401, a shutter plate 406 for moving back and forth in the axial directions, and a pair of compression coil springs 407 for urging the shutter plate 406 toward the opening 402 are disposed.

The shutter plate 406 is guided to move back and forth by the slide plates 404, 405 and the two contacts 403. The compression coil springs 407 are interposed between the other end side of the receptacle housing 401 and the shutter plate 406.

Moreover, the end portions of the slide plates 404, 405 on the side of the opening 402 are individually folded slightly inward. As a consequence, the shutter plate 406 can be prevented from jumping out of the opening 402.

The shell 408 of the metal plate has the not-shown tabs on its outer periphery. The not-shown tabs are welded to a printed-circuit board. As a consequence, the receptacle is fixed on the printed-circuit board.

Next, the actions of the micro-connector will be described in the following. The first description is made on the case, in which the plug 300 is to be connected to the receptacle 400.

First of all, the forward end of the plug housing 301 of the plug 300 is moved in the direction of an arrow G in FIG. 10 and is inserted into the opening 402 of the receptacle 400.

Then, the lock springs 303, 304 are pushed inward at their hook portions 33A, 34B by the slide plates 404, 405 so that they are elastically deformed in the directions to approach each other, that is, in the directions of arrows P of FIG. 10. At the same time, the rearward end of the plug housing 301 pushes and moves backward the shutter plate 406.

Moreover, the shutter 305 of the plug 300 is pushed by the wall face around the opening 402 of the receptacle 400 so that it moves back in the direction of an arrow R of FIG. 10 with respect to the plug housing 301.

When the forward end of the plug housing 301 of the plug 300 is further moved in the direction of an arrow G of FIG. 10, the hook portions 33A, 34B are fitted in the recesses 44A, 45B so that the plug 300 and the receptacle 400 are locked by the elastic restoring forces of the lock springs 303, 304.

Here, with the plug 300 and the receptacle 400 thus being locked, the shutter 305 and the shutter plate 406 are individually moved backward so that the contacts 302 and the contacts 403 are individually exposed and electrically connected with each other.

Next, here will be described the case, in which the plug 300 is to be removed from the receptacle 400.

In the state in which the plug 300 is connected to the receptacle 400, the plug 300 is pulled out of the receptacle 400 against the dragging resistance between the hook portions 33A, 34B of the lock springs 303, 304 and the recesses 44A, 45B. Then, the shutter 305 is urged to move in the direction of an arrow F of FIG. 10 by the pair of the compression coil springs 306. The shutter plate 406 is urged to move in the direction of an arrow H of FIG. 10 to shut the opening 402 by the pair of the compression coil springs 407.

In recent years, the electronic device such as a micro video camera or a mobile information terminal is rapidly small-sized. As a consequence, the connectors to be packaged in these electronic devices are desired to be small-sized. In this case, the contacts are disposed at a narrow distance. When the remaining parts slide on the contacts in the directions intersected by the plug inserting/extracting directions, they may deform the contacts to cause malfunctions.

In the aforementioned first connector, however, the plug is pulled out of the receptacle while pushing the lock levers of the plug with the fingers. As a matter of fact, the plug is pulled out of the receptacle while being shaken in the directions intersected by the extracting direction thereof. By these actions, the contacts may be deformed to cause failures between the contacts of the plug and the contacts of the receptacle.

In the aforementioned second connector, on the other hand, the plug is pulled out of the receptacle against the dragging resistance between the hook portions of the lock springs and the recesses. As a matter of fact, the plug is pulled out of the receptacle while being shaken in the directions intersected by extracting direction thereof. By these actions, the contacts may be deformed to cause failures between the contacts of the plug and the contacts of the receptacle.

In the second connector shown in FIG. 10, moreover, the plug 300 is locked in the receptacle 400 by the dragging resistance between the hook portions 33A, 34B of the lock springs 303, 304 and the recesses 44A, 45B. As a consequence, the locking of the plug 300 in the receptacle 400 is not reliable.

Therefore, the rigidity of the lock springs 303, 304 is enhanced to lock the plug 300 surely in the receptacle 400. Then, a high force is required for pulling the plug 300 out of the receptacle 400.

If the lock springs 303, 304 are made highly rigid, their hook portions 33A, 34B and the slide plates 404, 405 slide each other so that they are seriously worn. In addition, the end portions of the slide plates 404, 405 on the side of the opening 402 are also worn by the hook portions 33A, 34B, and the shutter plate 406 may jump out of the opening 402.

In a practical consideration, it is necessary that the plug 300 can be inserted into and extracted from the receptacle 400 by at least 8,000 to 10,000 times.

SUMMARY OF THE INVENTION

In order to solve the above-specified problems, the present invention has an object to provide a plug, which can reduce the contact failures between contacts, which can be surely connected to a receptacle and which can be easily removed from the receptacle, and a receptacle for use with the plug.

The following constructions are adopted to achieve the object of the present invention.

(1) A plug for being inserted into the opening of a receptacle, wherein said receptacle includes a recess in the inner wall of said opening, said plug comprises: an insulating plug frame portion having a cylindrical shape; an insulating header portion of a flat plate shape for being housed in said plug frame portion and exposed at its forward end to said receptacle; a pair of lock arms supported on the both side faces of said plug frame portion; and an insulating plug shutter for moving back and forth in the inserting/extracting directions with respect to said plug frame portion, wherein said header portion has a forward end for being inserted into the opening of said receptacle and includes contacts juxtaposed on its two faces, wherein each of said paired lock arms includes: a body extending toward said receptacle; a hook portion formed on the forward end side of said body and protruding from said plug frame portion for engaging in the recess of said receptacle; and an action member formed closer to the rearward end side than said hook portion, and wherein said plug shutter includes: a cylindrical shutter frame portion for covering said header portion; a pair of lever portions formed on the both side faces of said shutter frame portion and protruding from said plug frame portion; and a pair of projections formed on the both side faces of said shutter frame portion and disposed to confront said lock arms individually, whereby when said plug shutter is moved backward of said receptacle by holding said lever portions with the fingers, the projections of said plug shutter push the action members of said lock arms inward to elastically deform said lock arms inward thereby to move the hook portions of said lock arms inward.

According to the present invention of (1), the plug is connected to the receptacle in the following procedure.

Specifically, the lever portion is held with the finger to move backward of the receptacle. As a consequence, the header portion is exposed to the outside. Simultaneously with this, the projection of the plug shutter pushes the action member of the lock arm inward to deform the lock arm elastically inward thereby to move the hook portion of the lock arm inward. In this state, the header portion of the plug is inserted into the opening of the receptacle.

After this, the plug shutter is moved forward toward the receptacle, and the projection of the plug shutter then leaves the action member of the lock arm so that the hook portion of the lock arm returns to its original position and engages with the recess formed in the inner wall of the opening of the receptacle.

Here, the plug is removed from the receptacle in the procedure reversed from the aforementioned one. Therefore, the plug can be surely connected to the receptacle and can be easily disconnected from the receptacle.

When the plug is to be pulled out of the receptacle, moreover, it need not be shaken. Therefore, the remaining parts do not slide on the contacts in the directions intersected by the plug extracting direction. Thus, the plug can prevent the contacts from being deformed and poorly contact each other.

(2) In the plug of (1) further comprises: elastic members for urging the plug shutter toward the receptacle.

According to the present invention of (2), the elastic members are provided for urging the plug shutter toward the receptacle. Therefore, the plug shutter is urged to move toward the receptacle merely by releasing the finger from the lever portion. Thus, the plug can be more easily connected to the receptacle.

(3) In the plug of (2), the hook portions are individually formed to have a generally triangular section becoming thinner toward the forward ends, and the faces on the rearward end sides of the hook portions intersect the inserting/extracting directions of the plug.

According to the present invention of (3), when the plug is connected to the receptacle, the otter faces of the hook portions are guided by the edges of the opening of the receptacle so that the plug can be smoothly inserted into the receptacle.

In the state which the plug is connected to the receptacle, on the other hand, the faces of the rearward end sides of the hook portions intersect the inserting/extracting directions so that those faces can be surely engaged on the inner walls of the opening of the receptacle thereby to prevent the plug from coming out.

(4) In the plug of any one of (1) to (3), the shutter frame portion covers the header portion, when the plug shutter moves forward, and exposes the header portion when the plug shutter moves backward.

According to the present invention of (4), when the header portion is not inserted into the opening of the receptacle, the plug shutter moves forward so that the header portion can be protected by the shutter frame portion. When the header portion is inserted into the opening of the receptacle, the plug shutter is moved backward so that the contacts of the plug can be brought into contact with the contacts of the receptacle by exposing the header portion. At this time, the contacts of the plug are covered with and protected by the receptacle.

(5) The plug of any one of (1) to (4) further comprises a printed-circuit board for being connected to the rearward end sides of the contacts.

According to the present invention of (5), the contacts are arrayed at narrow intervals of 0.5 mm, for example, and are electrically connected with the printed-circuit board. Here, the wiring pattern of the printed-circuit board is formed to radiate outward so that the printed-circuit board can be easily connected to the conductors of the cable.

(6) The plug of any one of (1) to (5) further comprises a first shell made of a metal sheet for enveloping the plug frame portion and the header portion.

According to the present invention of (6), the plug frame portion and the header portion are enveloped with the first shell of the metal sheet so that they are structurally reinforced and shielded.

In case the opening of the receptacle into which the header portion is inserted is enveloped with a metal plate, the plug and the receptacle can be integrally shielded by connecting the plug to the receptacle.

(7) The plug of (6) further comprises: a cylindrical metal cover for covering the printed-circuit board; and a cable shielding clamp for shielding the metal cover.

According to the present invention of (7), the printed-circuit board is covered with the cylindrical metal cover, and this metal cover is shielded with the cable shielding clamp, so that the plug and the cable can be easily connected. Moreover, the plug and the cable shielding clamp can be easily disconnected from each other so that they can be simply maintained and inspected.

(8) A receptacle having an opening into which a plug is inserted, said receptacle comprises: a recess in the inner wall of said opening, wherein said plug includes: an insulating plug frame portion having a cylindrical shape; an insulating header portion of a flat plate shape for being housed in said plug frame portion and exposed at its forward end to said receptacle; a pair of lock arms supported on the both side faces of said plug frame portion; and an insulating plug shutter for moving back and forth in the inserting/extracting directions with respect to said plug frame portion, wherein said header portion has a forward end for being inserted into the opening of said receptacle and includes contacts juxtaposed on its two faces, wherein each of said paired lock arms includes: a body extending toward said receptacle; a hook portion formed on the forward end side of said body and protruding from said plug frame portion for engaging in the recess of said receptacle; and an action member formed on the rearward end side closer than said hook portion, and wherein said plug shutter includes: a cylindrical shutter frame portion for covering said header portion; a pair of lever portions formed on the both side faces of said shutter frame portion and protruding from said plug frame portion; and a pair of projections formed on the both side faces of said shutter frame portion and disposed to confront said lock arms individually, whereby when said plug shutter is moved backward of said receptacle by holding said lever portions with the fingers, the projections of said plug shutter push the action members of said lock arms inward to elastically deform said lock arms inward thereby to move the hook portions of said lock arms inward.

(9) In the receptacle of (8), the opening is enveloped at its edges with a second shell made of a metal.

The insulating property means an electrically insulating property.

The header portion and the plug frame portion may be integrally molded of a synthetic resin which is an electric insulator. Alternatively, they may be partially machined after they were integrally molded of the synthetic resin. Alternatively, they may be skived.

The contacts are preferable to be leaf springs arrayed at narrow intervals of about 0.5 mm. If the contacts are made of pins, they have to be clamped by slitted socket pins. These slitted socket pins may contact with each other so that the contacts cannot be arrayed with the narrow pitch of about 0.5 mm.

The contacts have about forty poles in case they are used as an interface connector, that is, about twenty contacts are disposed on one side of the header portion. According to the application of a connector, thirteen contacts (of twenty six poles) can be arrayed at most on one side of the header portion.

The shutter frame portion, the pair of lever portions and the pair of the projections may be molded integrally with one another.

Moreover, the shutter frame portion of the plug shutter may be slidably supported on the plug frame portion.

Moreover, each lever portion may be shaped to approach to the shutter frame portion as it extends to the receptacle. Then, the plug shutter can be easily moved with backward the fingers on the outer side faces of the lever portions. Here, these lever portions may be provided with the slip stoppers by wrinkling or double-cutting them.

Each lock arm may be fixed on the plug frame portion by pressing it into the plug frame portion. Alternatively, the individual lock arms may be integrated and fixed on the plug frame portion by means of fastening tools such as screws.

Each action member may be formed by folding the lock arm partially or preformed on the lock arm.

DETAILED DESCRIPTION OF THE PREFERRED EMBODIMENT

Figure 1:
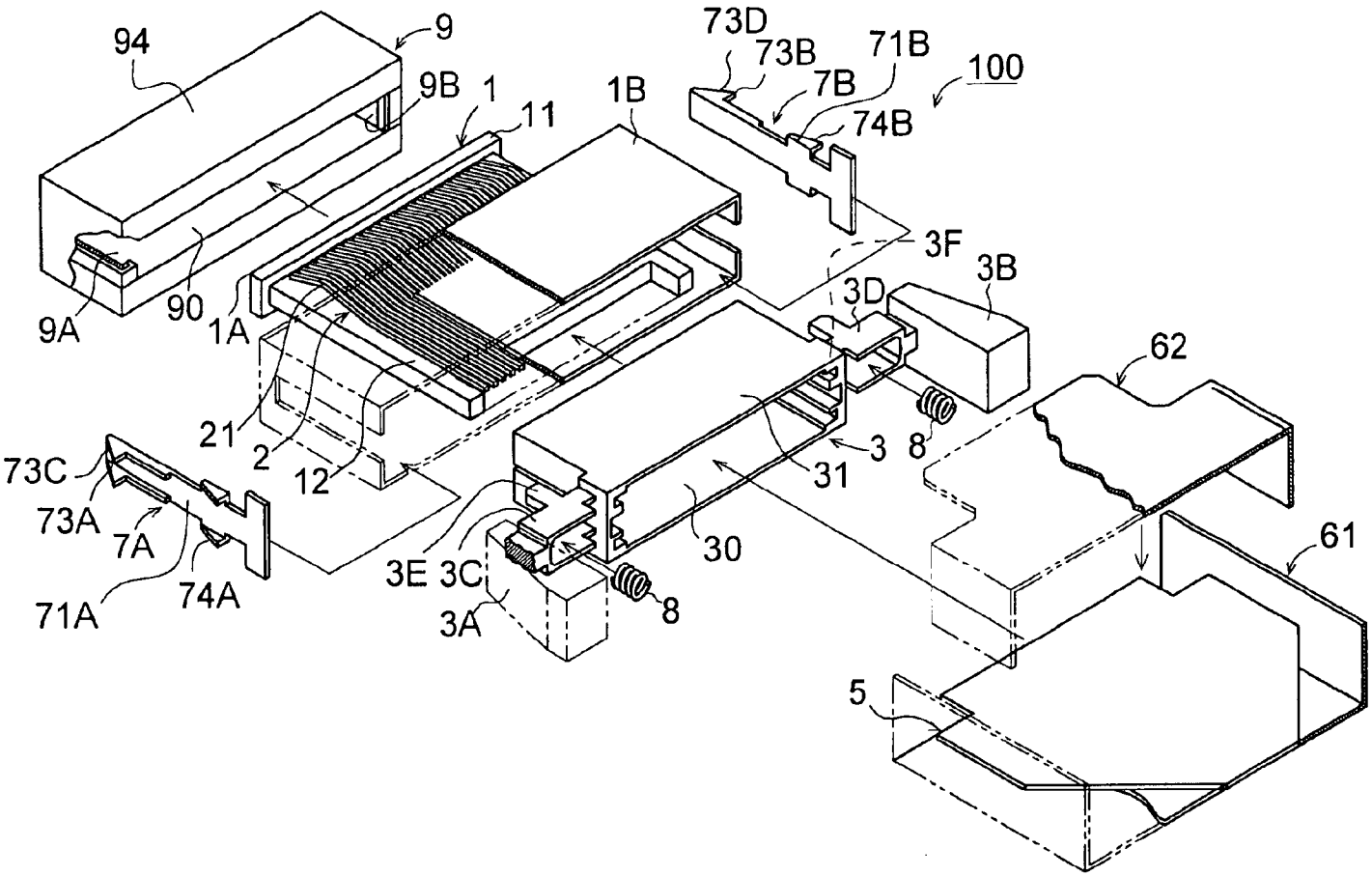
FIG. 1 is an exploded perspective view showing a schematic construction of a plug according to one embodiment of the present invention.

One embodiment of the present invention will be described with reference to the accompanying drawings. FIG. 1 is an exploded perspective view showing a schematic construction of the plug 100 according to an embodiment of the present invention.

Figure 2A:
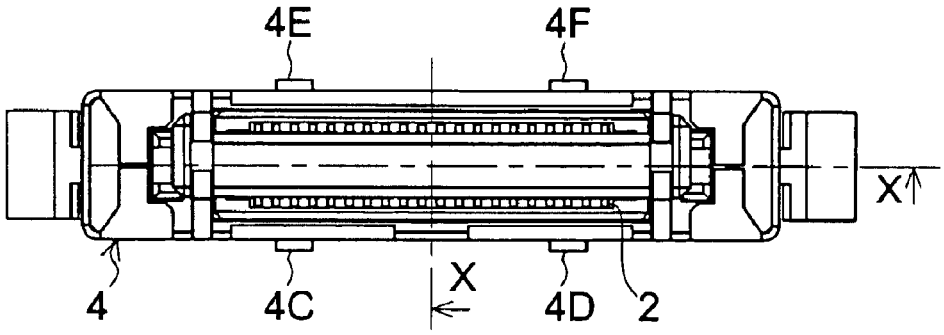
FIG. 2A is a front elevation of the plug according to the embodiment.
Figure 2B:
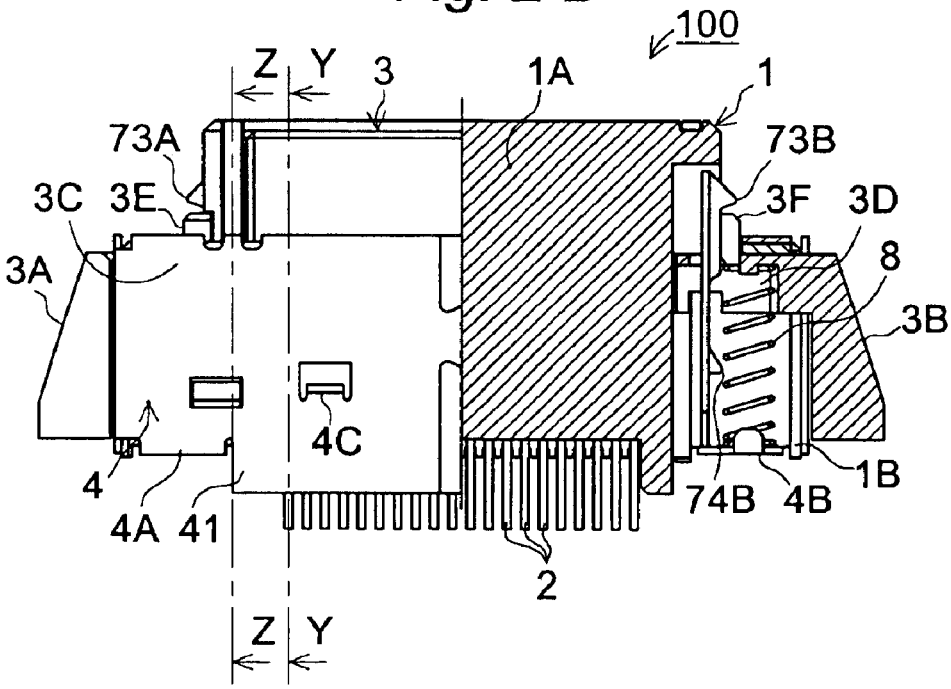
FIG. 2B is a top plan view of the plug according to the embodiment.

FIG. 2A is a front elevation of the plug 100, and FIG. 2B is a top plan view of the plug 100. Here, the right-hand half of FIG. 2B is a sectional view taken along arrows X—X of FIG. 2A.

Figure 3A:
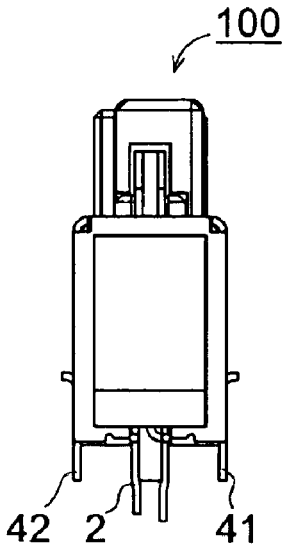
FIG. 3A is a side elevation of the plug according to the embodiment.
Figure 3B:
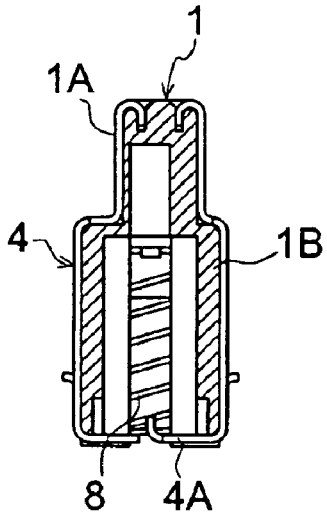
FIG. 3B is a sectional view taken along arrows Z—Z of FIG. 2A.
Figure 3C:
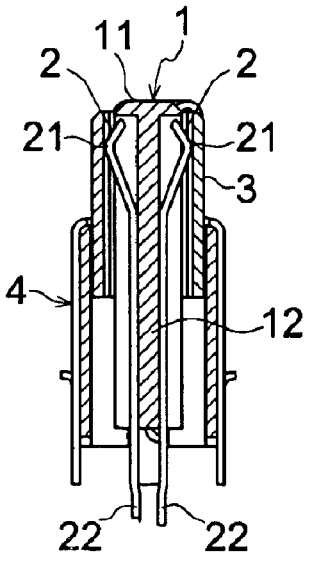
FIG. 3C is a sectional view taken along arrows Y—Y of FIG. 2A.

FIG. 3A is a side elevation of the plug 100; FIG. 3B is a sectional view taken along arrows Z—Z of FIG. 2A; and FIG. 3C is a sectional view taken along arrows Y—Y of FIG. 2A.

A microcontact includes a receptacle 9 and the plug 100 to be inserted into the receptacle 9.

The plug 100 includes an insulating plug housing 1, a pair of lock arms 7A, 7B, an insulating plug shutter 3, a pair of compression coil springs 8, and a later-described first shell 4 (as referred to FIG. 2).

The receptacle 9 is in a cylindrical shape having grooves 9A, 9B formed in its inner wall face. The receptacle 9 is opened at its one end side to form an opening 90 into which a later-described header portion 1A of the plug 100 is inserted. Moreover, the receptacle 9 includes a second shell 94 made of a metal sheet, and this second shell 94 envelops the housing of the receptacle 9 and extends from the edges of the opening 90 up to the inner wall face.

The plug housing 1 includes an insulating cylindrical plug frame portion 1B, and the insulating flat-shaped header portion 1A which is housed in the plug frame portion 1B and exposed at its forward end toward the receptacle 9. These header portion 1A and plug frame portion 1B are made integral with each other.

The header portion 1A can be inserted at its forward end into the opening of the receptacle 9, and includes a mounted plate portion 12 having a flat plate shape and an umbrella portion 11 formed at the forward end of the mounted plate portion 12. These mounted plate portion 12 and umbrella portion 11 are formed to have a T-shaped section (as referred to FIG. 3C).

A plurality of grooves is formed in comb teeth shape in the front and back faces of the mounted plate portion 12. By pressing a plurality of contacts 2 into those grooves, the contacts 2 are arrayed in the so-called "dual-in-line" shape.

The contacts 2 are made of a bent leaf spring and have bent portions 21 protruded to the outer side.

The bent portions 21 of the contacts 2 can be elastically deformed and have a height slightly larger than that of the umbrella portion 11 (as referred to FIG. 3C). When the header portion 1A is inserted into the receptacle 9, therefore, the bent portions 21 are pushed by the female contacts of the receptacle 9 so that they are elastically deformed to contact with the female contacts of the receptacle 9.

Moreover, the individual rearward ends of the contacts 2 juxtaposed in a pair are extended from the rearward end of the header portion 1A.

The plug shutter 3 includes a cylindrical shutter frame portion 31, a pair of lever portions 3A, 3B formed on the both side faces of the shutter frame portion 31 and protruding from the shutter frame portion 31, and a pair of projections 3E, 3F formed on the both side faces of the shutter frame portion 31 and disposed to confront the lock arms 7A, 7B.

The shutter frame portion 31 has a plurality of grooves formed in the axial direction in the two inner wall side faces and is opened on its two end faces to form openings 30.

This shutter frame portion 31 is housed in the plug frame portion 1B and is so supported on the plug frame portion 1B as can be moved back and forth in the extracted and inserted directions. In the state which the shutter frame portion 31 moves toward the receptacle 9, the forward end of the shutter frame portion 31 covers the header portion 1A.

On the side face of the shutter frame portion 31 on which the lever portion 3A is disposed, an open chamber portion 3C is formed. The open chamber portion 3C has the lever portion 3A at its forward end and the projection 3E at its center.

On the side face of the shutter frame portion 31 on which the lever portion 3B is disposed, an open chamber portion 3D is formed. The open chamber portion 3D has the lever portion 3B at its forward end and the projection 3F at its center.

These shutter frame portion 31, lever portions 3A, 3B, projections 3E, 3F, and open chamber portions 3C, 3D are made integral with one another. Moreover, the lever portions 3A, 3B and the projections 3E, 3F are individually exposed from the side faces of the plug frame portion 1B.

The lever portions 3A, 3B are shaped to approach inward as they extend toward the receptacle 9. As a consequence, the plug shutter 3 can be easily moved backward by pushing the lever portions 3A, 3B with the fingers. Moreover, these lever portions 3A, 3B are wrinkled to prevent the fingers from slipping.

The first lock arms 7A, 7B are made of leaf springs and are pressed into the plug frame portion 1B and supported by both side faces of the plug frame portion 1B. The first lock arms 7A, 7B include: bodies 71A, 71B extending toward the receptacle 9; hook portions 73A, 73B formed on the forward end sides of the bodies 71A, 71B and protruding from the plug frame portion 1B for engaging on the inner wall of the opening 90 of the receptacle 9; and action members 74A, 74B formed at portions closer to the rearward ends than the hook portions 73A, 73B.

These hook portions 73A, 73B are individually formed to has a generally triangular section and become thinner as they extend toward their forward ends.

Specifically, the outer side faces of the hook portions 73A, 73B are slopes 73C, 73D, which are to touch against the edges of the opening 90 of the receptacle 9. Moreover, the faces on the rearward end sides of the hook portions 73A, 73B intersect the inserting/extracting directions of the plug 100 so that they are engaged in the grooves 9A, 9B formed in the inner wall of the opening 90.

When the plug 100 is connected to the receptacle 9, the slopes 73C, 73D of the hook portions 73A, 73B are guided by the edges of the opening 90 of the receptacle 9 so that the plug 100 can be smoothly inserted into the receptacle 9.

In the state which the plug 100 is connected to the receptacle 9, on the other hand, the faces of the rearward end sides of the hook portions 73A, 73B intersect the inserting/extracting directions of the plug 100 so that those faces can be surely engaged on the inner walls of the opening 90 of the receptacle 9 thereby to prevent the plug 100 from coming out.

The action members 74A, 74B and the projections 3E, 3F have slopes confronting each other. When the shutter frame portion 31 is moved backward from the state shown in FIG. 2B, the projections 3E, 3F are also moved backward so that their slopes push and move the slopes of the later-described action members 74A, 74B inward.

The compression coil springs 8 acting as elastic members urge the plug shutter 3 toward the receptacle 9. The one ends of the compression coil springs 8 are so inserted into the open chamber portions 3C, 3D of the plug shutter 3 as to push the inner walls of the open chamber portions 3C, 3D. The other ends of the compression coil springs 8 push the later-described folded members 4A, 4B of the shell 4.

The first shell 4 is formed by folding a metal sheet having a thickness of about 0.2 mm. The first shell 4 envelopes the outer wall faces of the plug frame portion 1B and the header portion 1A in close contact. Since the plug frame portion 1B and the header portion 1A are enveloped with the first shell 4 of the metal sheet, they can be structurally reinforced and shielded.

On the central portion of the lower face of the shell 4, on the other hand, folded members 4C, 4D are formed. These folded members 4C, 4D are adapted to be fitted in through holes 61C, 61D of the later-described metal cover 61.

At the central portion on the rear end side of the lower face of the shell 4, a protruding member 41 protruding backward is formed. This protruding member 41 is clamped by the later-described folded members 62C, 62D.

At the central portion of the upper face of the shell 4, folded members 4E, 4F are formed. These folded members 4E, 4F are adapted to be fitted in through holes 62A, 62B of the later-described metal cover 62.

At the central portion on the rear end side of the upper face of the shell 4, a protruding member 42 protruding backward is formed. This protruding member 42 is clamped by the later-described folded members 61E, 61F.

The folded members 4A, 4B are formed on the both sides of the protruding member 42 on the upper face of the shell 4 and on the both sides of the protruding member 41 on the lower face. Those folded members 4A, 4B are folded to support the other ends of the compression coil springs 8. Here, the folded members 4A, 4B are folded up after the compression coil springs 8 were inserted into the open chamber portions 3C, 3D.

Figure 4A:
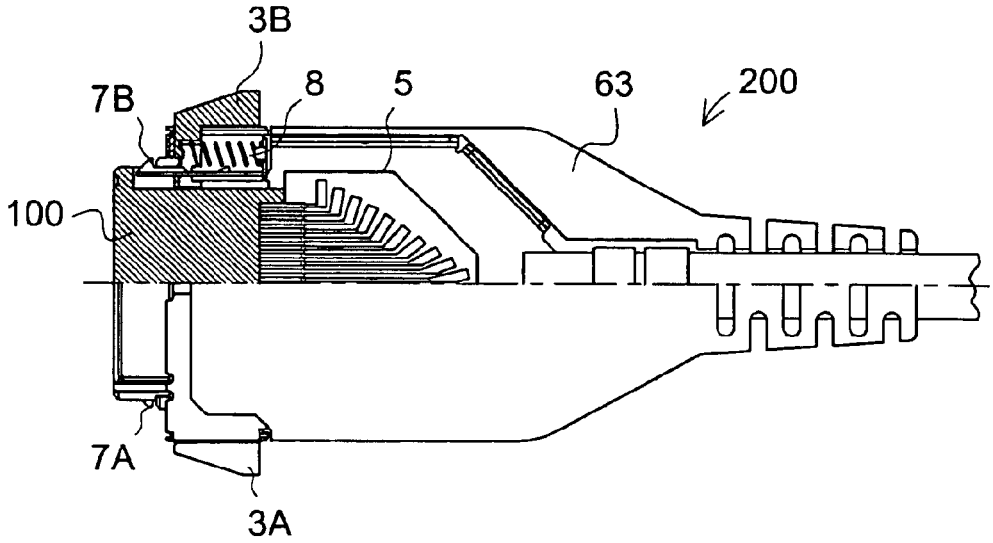
FIG. 4A is a top plan view of a cable plug to which the plug according to the embodiment is applied.
Figure 4B:
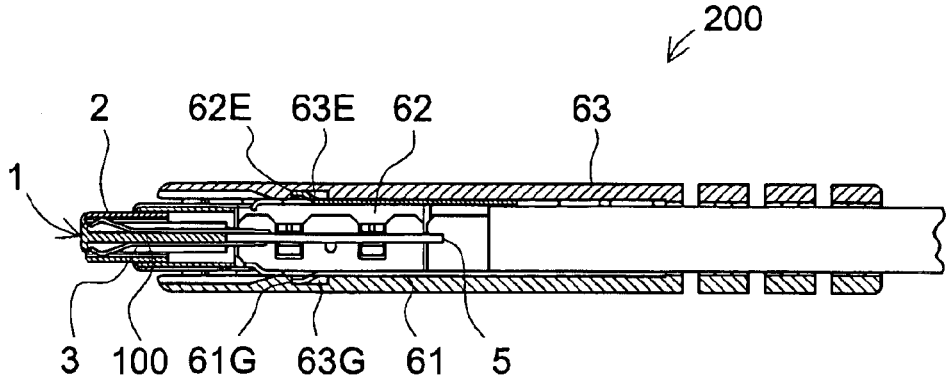
FIG. 4B is a longitudinal section of FIG. 4A.

Next, a cable plug 200 to which the plug 100 is applied will be described with reference to FIGS. 4A, 4B to FIG. 6. FIG. 4A is a top plan view of the cable plug 200, and FIG. 4B is a longitudinal section of FIG. 4A. Here, the upper half of FIG. 4A is a sectional top plan view.

The cable plug 200 is provided with not only the aforementioned plug 100 but also: a printed-circuit board 5 for being connected with the rearward end sides of the contacts 2; the metal covers 61, 62 for covering the printed-circuit board 5; and a cable shielding clamp 63 for shielding the metal covers 61, 62.

Figure 5:
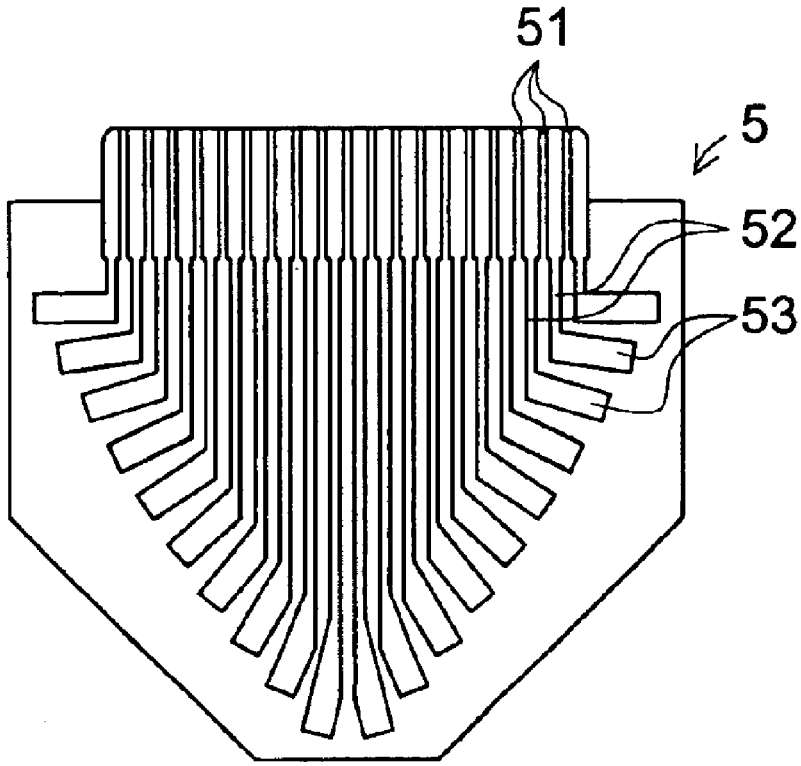
FIG. 5 is a top plan view of a printed-circuit board for the cable plug according to the embodiment.

FIG. 5 is a top plan view of the printed-circuit board 5.

This printed-circuit board 5 is printed with wires 52 on its front and back faces. The wires 52 individually include line connection terminals 51 to be connected with the contacts 2, and terminal lands 53 to be connected with the conductors of the cable.

The contacts 2 are arrayed at narrow intervals of 0.5 mm, for example. The two faces of the line connection terminals 51 are welded to the rearward end sides of the contacts 2 so that the printed-circuit board 5 is connected to the plug 100.

The wires 52 radiate outward to make narrow intervals between the line connection terminals 51 and wide intervals between the terminal lands 53. When the contacts 2 are to be electrically connected with the conductors of the cable, therefore, the space for connecting the terminal lands 53 of the wire pattern 52 with the conductors of the cable can be easily secured.

That is, this printed-circuit board 5 bears the role of a relay board for transforming the connection terminals of the narrow intervals into the connection terminals of the wide intervals. More over, electric parts such as adjust resistors or delay elements can be packaged in the printed-circuit board 5.

Figure 6:
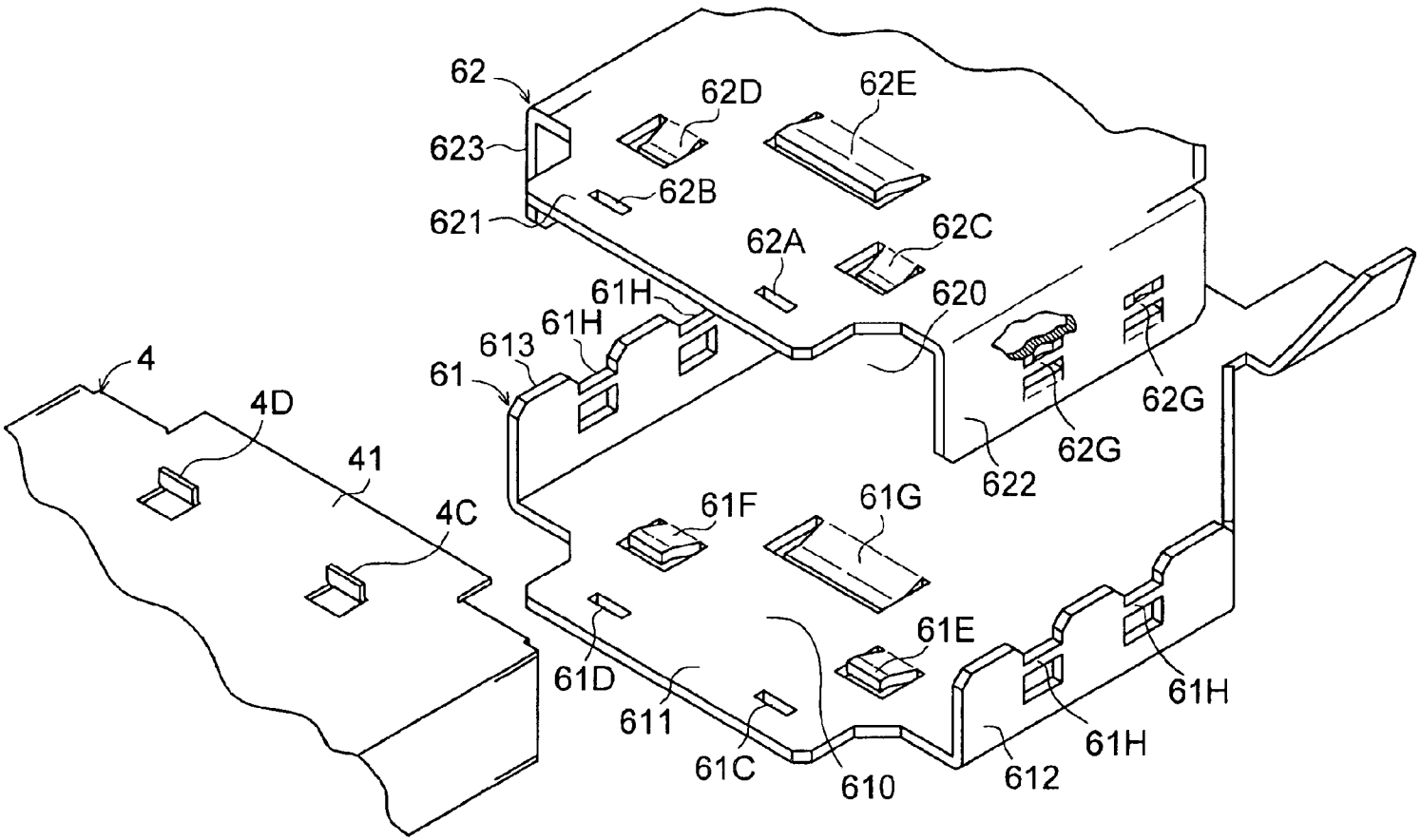
FIG. 6 is a perspective view of a metal cover of the cable plug according to the embodiment.

FIG. 6 is a perspective view of the metal covers which constitutes the cable plug 200.

The metal covers 61, 62 are configured by combining the first metal cover 61 and the second metal cover 62.

The metal cover 61 is formed of a stainless steel sheet having a thickness of about 0.3 mm, for example, into a shape having a C-shaped section. The metal cover 61 includes a bottom face 611, and side faces 612, 613 erected from the both sides of the bottom face 611.

In the bottom face 61, rectangular through holes 61C, 61D are formed. In these through holes 61C, 61D, the folded members 4E, 4F (as referred to FIG. 2A) of the first shell 4 are fitted.

At the back of the through holes 61C, 61D of the metal cover 61, folded members 61E, 61F, which protrude inward are formed. The projecting member 42 (as referred to FIG. 3A) of the shell 4 is clamped in the folded members 61E, 61F. At the back of the folded members 61E, 61F of the metal cover 61, a folded member 61G, which is protruded outward, is formed.

The metal cover 62 is formed of a stainless steel sheet having a thickness of about 0.3 mm, for example, into a shape having a C-shaped section. The metal cover 62 includes a bottom face 621, and side faces 622, 623 erected from the both sides of the bottom face 621.

In the bottom face 62, rectangular through holes 62A, 62B are formed. In these through holes 62A, 62B, the folded members 4C, 4D (as referred to FIG. 2A) of the first shell 4 are fitted.

At the back of the through holes 62A, 62B of the metal cover 62, folded members 62C, 62D, which protrude inward are formed. The projecting member 41 of the shell 4 is clamped in the folded members 62C, 62D. At the back of the folded members 62C, 62D of the metal cover 62, a folded member 62E, which is protruded outward, is formed.

On the side faces 612, 613 of the metal cover 61, individually, two ribs 61H are formed. In the side faces 622, 623 of the metal cover 62, individually, two indents 62G, which are protruded inward are formed.

The metal cover 61 is connected to the metal cover 62 when the indents 62G of the metal cover 62 are fitted on the ribs 61H of the metal cover 61.

As shown in FIG. 4, the cable shielding clamp 63 has a rectangular cylinder shape and shields the metal covers 61, 62. A recess 63E is formed in the upper face side of the cable shielding clamp 63. A recess 63G is formed in the lower face side of the cable shielding clamp 63. The folded members 61G, 62E of the metal covers 61, 62 are fitted in those recesses 63G, 63E, respectively.

The plug and the cable are connected in the following procedure.

The metal covers 61, 62 are connected to each other, and these connected metal covers 61, 62 are inserted into the cable shielding clamp 63. Thus, the metal covers 61, 62 are attached to the cable shielding clamp 63.

Next, the cable is inserted into the cable shielding clamp 63, and its forward end side is connected to the printed-circuit board 5 of the plug 100. After this, the rearward end side of the cable is pulled to house the printed-circuit board 5 of the plug 100 in the metal covers 61, 62.

As a result, the plug 100 can be easily connected to the cable shielding clamp 63. Moreover, the plug 100 and the cable shielding clamp 63 can be easily disconnected from each other so that they can be simply wired or maintained and inspected.

In this embodiment, the plug 100 can have forty poles, and the contacts 2 can have a pitch of 0.5 mm.

Next, the actions to insert the plug 100 of this embodiment into the receptacle 9 will be described with reference to FIGS. 7A, 7B and FIG. 9. Here, the following description will be made exclusively on the side of the plug 100 on which the lever portion 3A is formed, but a similar description is applied to the side of the plug 100 on which the lever portion 3B is formed.

Figure 7A:
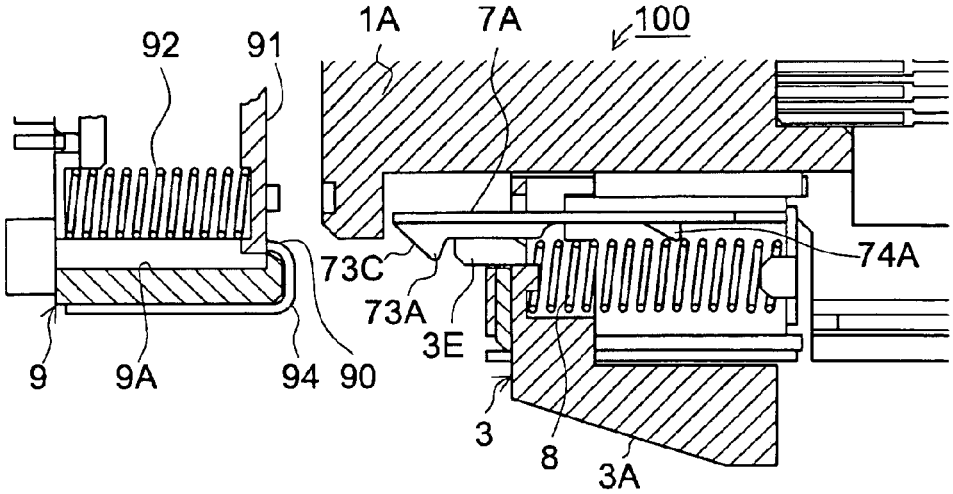
FIG. 7A is a sectional top plan view in a state before the plug according to the embodiment is inserted into a receptacle.
Figure 7B:
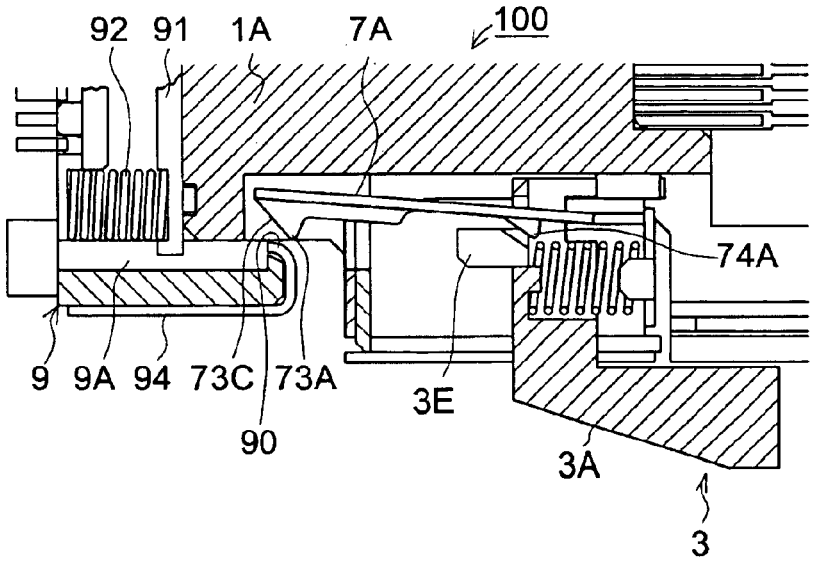
FIG. 7B is a sectional top plan view of the state in which the plug according to the embodiment is being inserted into the receptacle.

FIG. 7A is a sectional top plan view of the state before the plug 100 is inserted into the receptacle 9, and FIG. 7B is a sectional top plan view of the state, in which the plug 100 is being inserted into the receptacle 9. FIG. 9 is a longitudinal section of the state, in which the plug 100 has been inserted and locked in the receptacle 9.

In FIG. 7A, the shutter 91 of the receptacle 9 is so urged by a compression coil spring 92 as to move toward the opening 90 thereby to shut the opening 90.

From this state, the lever portion 3A is held with the finger, as shown in FIG. 7B, to moved a plug shutter 3 backward of the receptacle 9. As a consequence, the header portion 1A is exposed to the outside. Simultaneously with this, the projection 3E of the plug shutter 3 pushes the action member 74A of the lock arm 7A inward to deform the lock arm 7A elastically inward thereby to move the hook portion 73A of the lock arm 7A inward. In this state, the header portion 1A of the plug 100 is inserted into the opening 90 of the receptacle 9.

After this, the plug shutter 3 is urged by the compression coil spring 8 merely by releasing the finger from the lever portion 3A so that it move toward the receptacle 9. Then, the projection 3E of the plug shutter 3 leaves the action member 74A of the lock arm 7A so that the hook portion 73A of the lock arm 7A returns to its original position and is engaged in the groove 9A formed in the inner wall of the opening 90. As a consequence, the plug 100 is locked by the receptacle 9.

At the same time, the shutter frame portion 31 of the plug shutter 3 moved toward the receptacle 9 by the compression coil spring 8 until the shutter frame portion 31 touches the wall face around the opening 90 of the receptacle 9. This plug shutter 3 is urged toward the receptacle 9 by the compression coil spring 8 thereby to keep the locked state between the plug 100 and the receptacle 9.

In this state, the plug shutter 3 is moved backward by the push of the wall face around the opening 90 of the receptacle 9 so that the header portion 1A is exposed to the outside. However, this header portion 1A is shielded and protected by the receptacle 9.

Figure 9:
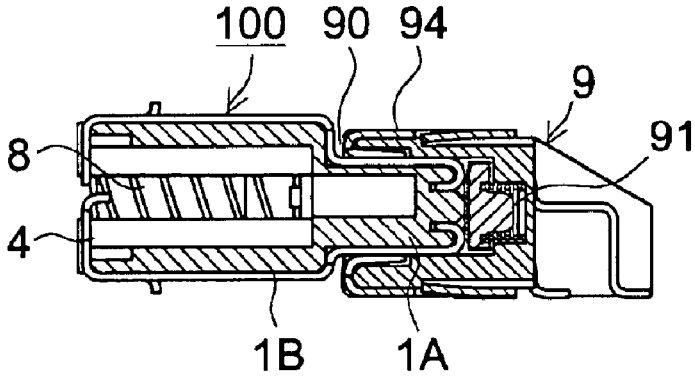
FIG. 9 is a longitudinal section of the state in which the plug according to the embodiment has been inserted and engaged in the receptacle.
Figure 10:
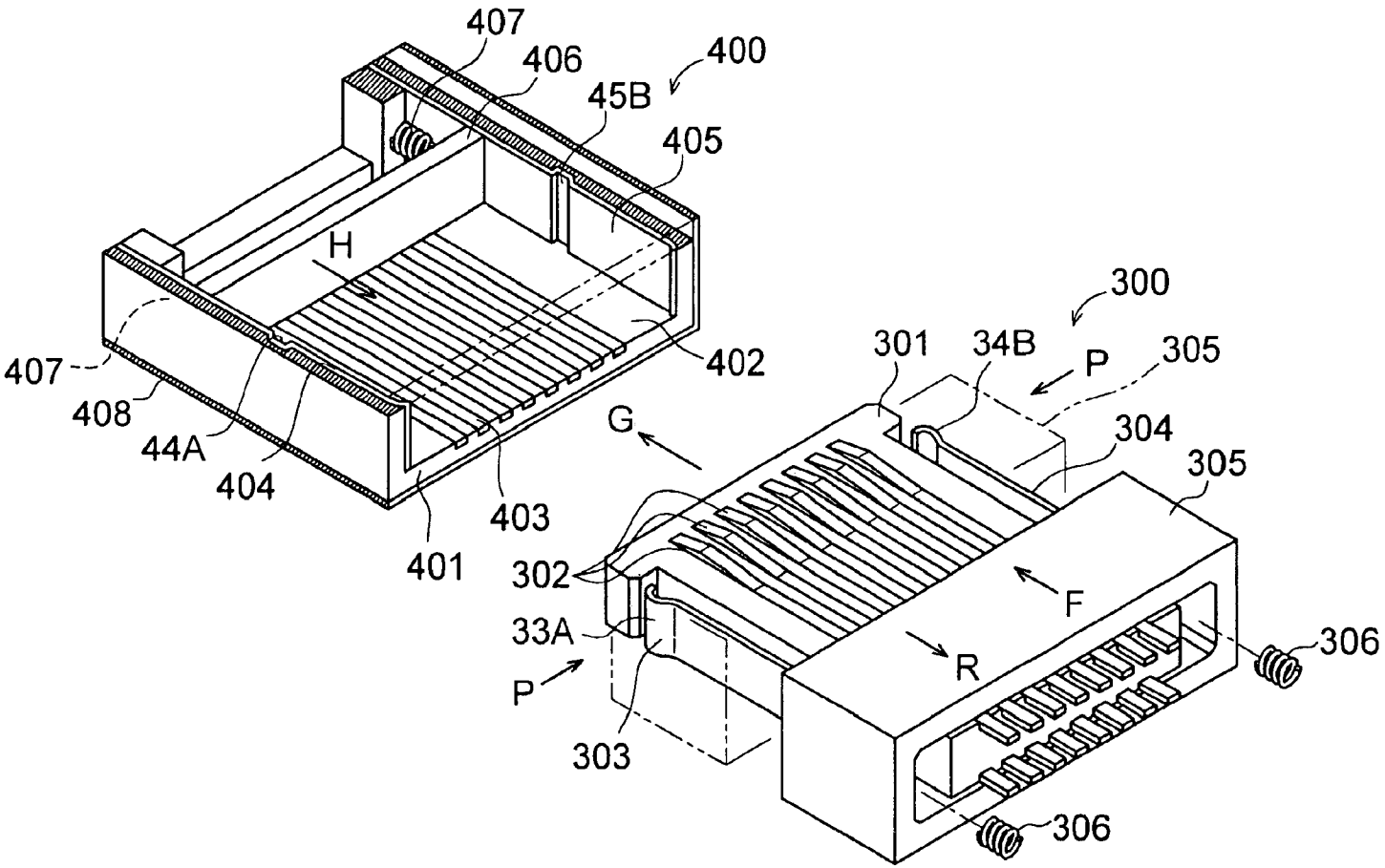
FIG. 10 is a perspective view of the plug according to the background art.

In this state, as shown in FIG. 9, the header portion 1A of the plug 100 has been inserted in the opening 90 of the receptacle 9. Therefore, the first shell 4 of the plug 100 and the second shell 94 of the receptacle 9 are jointed to each other thereby to shield the plug 100 and the receptacle 9 integrally.

Next, the operation to retract the plug 100 according to this embodiment from the receptacle 9 will be described with reference to FIGS. 8A, 8B.

Figure 8A:
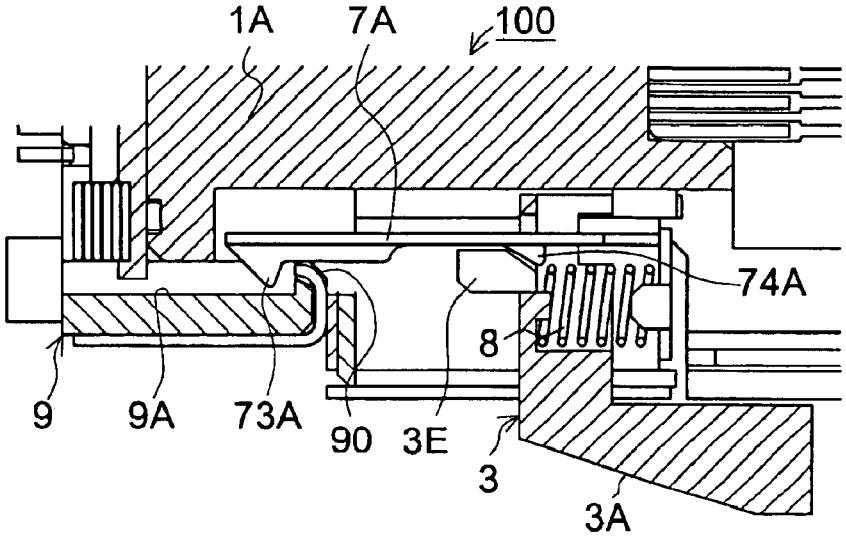
FIG. 8A is a sectional top plan view of the state in which the plug according to the embodiment has been inserted into the receptacle.
Figure 8B:
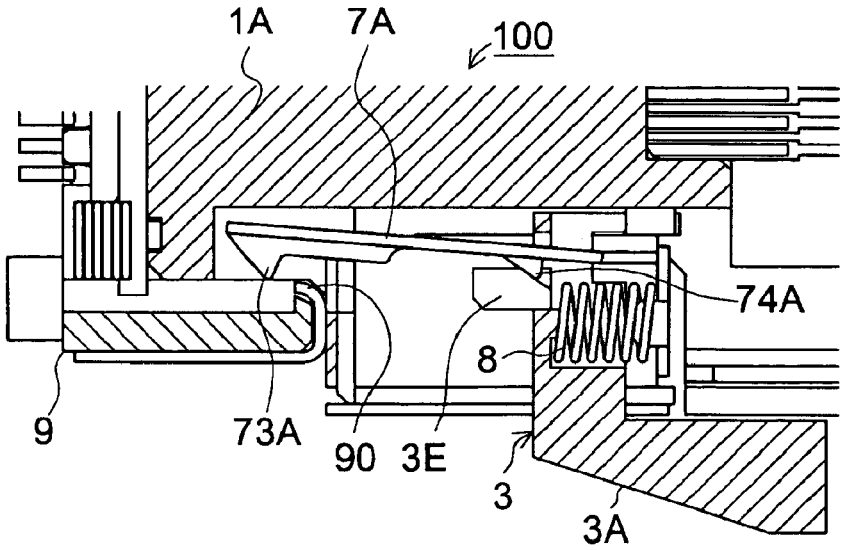
FIG. 8B is a sectional top plan view of the state in which the plug according to the embodiment is being pulled out of the receptacle.

FIG. 8A is a sectional top plan view of the state, in which the plug 100 has been inserted into the receptacle 9, and FIG. 8B is a sectional top plan view of the state, in which the plug 100 is being pulled out of the receptacle 9.

By holding the lever portion 3A with the finger, as shown in FIG. 8A, the plug shutter 3 is retracted away from the receptacle 9. As a consequence, the projection 3E of the plug shutter 3 pushes the action member 74A of the lock arm 7A inward, as shown in FIG. 8B, to deform the lock arm 7A elastically inward thereby to move the hook portion 73A of the lock arm 7A inward. In this state, the header portion 1A of the plug 100 is pulled out of the opening 90 of the receptacle 9.

After this, the plug shutter 3 is urged by the compression coil spring 8 merely by releasing the finger from the lever portion 3A so that it moves toward the receptacle 9. Then, the projection 3E of the plug shutter 3 leaves the action member 74A of the lock arm 7A so that the hook portion 73A of the lock arm 7A returns to its original position. Simultaneously with this, the shutter frame portion 31 of the plug shutter 3 which has moved protects the header portion 1A.

The following effects can be obtained according to the plug and the receptacle of the present invention.

The plug can be surely connected to the receptacle and can be easily disconnected from the receptacle.

When the plug is to be pulled out of the receptacle, it need not be shaken. Therefore, the remaining parts do not slide on the contacts in the directions intersected by the plug extracting direction. Thus, the plug can prevent the contacts from being deformed and poorly contact each other.

What is claimed is:

1. A plug for being inserted into the opening of a receptacle, wherein said receptacle includes a recess in the inner wall of said opening, said plug comprises:

an insulating plug frame portion having a cylindrical shape;

an insulating header portion of a flat plate shape for being housed in said plug frame portion and exposed at its forward end to said receptacle;

a pair of lock arms supported on the both side faces of said plug frame portion; and an insulating plug shutter for moving back and forth in the inserting/extracting directions with respect to said plug frame portion, wherein said header portion has a forward end for being inserted into the opening of said receptacle and includes contacts juxtaposed on its two faces, wherein each of said paired lock arms includes: a body extending toward said receptacle; a hook portion formed on the forward end side of said body and protruding from said plug frame portion for engaging in the recess of said receptacle; and an action member formed closer to the rearward end side than said hook portion, and wherein said plug shutter includes: a cylindrical shutter frame portion for covering said header portion; a pair of lever portions formed on the both side faces of said shutter frame portion and protruding from said plug frame portion; and a pair of projections formed on the both side faces of said shutter frame portion and disposed to confront said lock arms individually, whereby when said plug shutter is moved backward of said receptacle by holding said lever portions with the fingers, the projections of said plug shutter push the action members of said lock arms inward to elastically deform said lock arms inward thereby to move the hook portions of said lock arms inward.

2. A plug according to claim 1, further comprising:

elastic members for urging said plug shutter toward said receptacle.

3. A plug according to claim 2, wherein said hook portions are individually formed to have a generally triangular section becoming thinner toward the forward ends, and wherein the faces on the rearward end sides of said hook portions intersect the inserting/extracting directions of said plug.

4. A plug according to any one of claims 1 to 3, wherein said shutter frame portion covers said header portion, when said plug shutter moves forward, and exposes said header portion when said plug shutter moves backward.

5. A plug according to any one of claims 1 to 3, further comprising:

a printed-circuit board for being connected to the rearward end sides of said contacts.

6. A plug according to any one of claims 1 to 3, further comprising:

a first shell made of a metal sheet for enveloping said plug frame portion and said header portion.

7. A plug according to claim 6, further comprising:

a cylindrical metal cover for covering said printed-circuit board; and a cable shielding clamp for shielding said metal cover.

8. A receptacle having an opening into which a plug is inserted, said receptacle comprises:

a recess in the inner wall of said opening, wherein said plug includes: an insulating plug frame portion having a cylindrical shape; an insulating header portion of a flat plate shape for being housed in said plug frame portion and exposed at its forward end to said receptacle; a pair of lock arms supported on the both side faces of said plug frame portion; and an insulating plug shutter for moving back and forth in the inserting/extracting directions with respect to said plug frame portion, wherein said header portion has a forward end for being inserted into the opening of said receptacle and includes contacts juxtaposed on its two faces, wherein each of said paired lock arms includes: a body extending toward said receptacle; a hook portion formed on the forward end side of said body and protruding from said plug frame portion for engaging in the recess of said receptacle; and an action member formed on the rearward end side closer than said hook portion, and wherein said plug shutter includes: a cylindrical shutter frame portion for covering said header portion; a pair of lever portions formed on the both side faces of said shutter frame portion and protruding from said plug frame portion; and a pair of projections formed on the both side faces of said shutter frame portion and disposed to confront said lock arms individually, whereby when said plug shutter is moved backward of said receptacle by holding said lever portions with the fingers, the projections of said plug shutter push the action members of said lock arms inward to elastically deform said lock arms inward thereby to move the hook portions of said lock arms inward.

9. A receptacle according to claim 8, wherein said opening is enveloped at its edges with a second shell made of a metal.

* * * * *